US011172290B2

(12) United States Patent
Mate et al.

(10) Patent No.: US 11,172,290 B2
(45) Date of Patent: Nov. 9, 2021

(54) PROCESSING AUDIO SIGNALS

(71) Applicant: NOKIA TECHNOLOGIES OY, Espoo (FI)

(72) Inventors: Sujeet Shyamsundar Mate, Tampere (FI); Lasse Laaksonen, Tampere (FI)

(73) Assignee: NOKIA TECHNOLOGIES OY, Espoo (FI)

( * ) Notice: Subject to any disclaimer, the term of this patent is extended or adjusted under 35 U.S.C. 154(b) by 0 days.

(21) Appl. No.: 16/767,657

(22) PCT Filed: Nov. 15, 2018

(86) PCT No.: PCT/FI2018/050835
§ 371 (c)(1),
(2) Date: May 28, 2020

(87) PCT Pub. No.: WO2019/106228
PCT Pub. Date: Jun. 6, 2019

(65) Prior Publication Data

US 2020/0304908 A1 Sep. 24, 2020

(30) Foreign Application Priority Data

Dec. 1, 2017 (GB) ..... 1720067

(51) Int. Cl.
*H04R 3/00* (2006.01)
*H04R 5/04* (2006.01)
*H04R 5/027* (2006.01)

(52) U.S. Cl.
CPC ..... *H04R 3/005* (2013.01); *H04R 5/027* (2013.01); *H04R 5/04* (2013.01);
(Continued)

(58) Field of Classification Search
CPC ..... H04R 3/005; H04R 5/027; H04R 5/04; H04R 2201/401; H04R 2430/23; H04S 2420/01; H04S 2400/15
See application file for complete search history.

(56) References Cited

U.S. PATENT DOCUMENTS 8,194,872 B2 6/2012 Buck et al.
8,938,078 B2 1/2015 Meyer
(Continued)

FOREIGN PATENT DOCUMENTS

GB 2540175 A 1/2017
GB 2540224 A 1/2017
(Continued)

OTHER PUBLICATIONS

Take the Guesswork Out of Phase Alignment, SoundRadix (Mar. 23, 2015) 7 pages.
(Continued)

*Primary Examiner* — Regina N Holder
(74) *Attorney, Agent, or Firm* — Alston & Bird LLP

(57) ABSTRACT

A method, apparatus and computer program, the method comprising: obtaining a first audio signal emitted by an audio source, wherein the first audio signal is captured by a first microphone located at a first position; obtaining at least one second audio signal emitted by the same audio source, wherein the at least one second audio signal is captured by one or more second microphones located at one or more second positions which are different to the first position; determining if one or more of the second audio signals were obtained within a threshold time; and if one or more second audio signals were obtained within the threshold time causing the one or more second audio signals that were obtained within the threshold time to be processed for rendering spatial audio to a user; and if one or more second audio signals were not obtained within the threshold time causing,
(Continued)

at least part of, the one or more second audio signals that were not obtained within the threshold time to be discarded.

20 Claims, 6 Drawing Sheets

(52) U.S. Cl.
CPC .... *H04R 2201/401* (2013.01); *H04R 2430/23* (2013.01); *H04S 2400/15* (2013.01); *H04S 2420/01* (2013.01)

(56) References Cited

U.S. PATENT DOCUMENTS

| | | | |
|---|---|---|---|
| 9,111,580 | B2 | 8/2015 | Kirsch |
| 9,319,782 | B1 | 4/2016 | Crump et al. |
| 2016/0029122 | A1 | 1/2016 | Domingo Yaguez et al. |
| 2017/0026740 | A1 | 1/2017 | Kirsch et al. |
| 2017/0034640 | A1 | 2/2017 | Kirsch |

FOREIGN PATENT DOCUMENTS

| | | | |
|---|---|---|---|
| GB | 2543276 | A | 4/2017 |
| GB | 2566978 | A | 4/2019 |
| WO | WO 2017/005981 | A1 | 1/2017 |

OTHER PUBLICATIONS

Marti, A. et al., A Real-Time Sound Source Localization and Enhancement System Using Distributed Microphones, AES Convention (May 13, 2011) 8 pages.
International Search Report and Written Opinion for PCT/FI2018/050835 dated Mar. 6, 2019, 14 pages.
Extended European Search Report for European Application No. 18884819.6 dated Jun. 18, 2021, 14 pages.

PROCESSING AUDIO SIGNALS

CROSS-REFERENCE TO RELATED APPLICATIONS

This application is a national phase entry of International Application No. PCT/FI2018/050835, filed Nov. 15, 2018, the entire contents of which are incorporated herein by reference.

TECHNOLOGICAL FIELD

Examples of the disclosure relate to processing audio signals. In some examples they relate to processing audio signals to enable temporal alignment of audio signals.

BACKGROUND

Sound spaces may be recorded and rendered in any applications where spatial audio is used. For example the sound spaces may be recorded for use in mediated reality content applications such as virtual reality or augmented reality applications.

In order to enable a sound space to be rendered for a user one or more microphones obtain audio signals from different locations. As the microphones are located in different locations there are delays between the signals obtained by the different microphones. These delays may arise from the time taken for the sound to be propagated from a sound source to microphones at different locations and from jitter within a communication system which may send the captured audio signals from the microphones to a processing device, or from any other suitable source. It is useful to enable these delays to be taken into account when processing the audio signals.

BRIEF SUMMARY

According to various, but not necessarily all, examples of the disclosure there is provided a method comprising: obtaining a first audio signal emitted by an audio source, wherein the first audio signal is captured by a first microphone located at a first position; obtaining at least one second audio signal emitted by the same audio source, wherein the at least one second audio signal is captured by one or more second microphones located at one or more second positions which are different to the first position; determining if one or more of the second audio signals were obtained within a threshold time; and if one or more second audio signals were obtained within the threshold time causing the one or more second audio signals that were obtained within the threshold time to be processed for rendering spatial audio to a user; and if one or more second audio signals were not obtained within the threshold time causing, at least part of, the one or more second audio signals that were not obtained within the threshold time to be discarded.

The threshold time may be determined by an interactivity index.

The threshold time may be determined so as to avoid perceptible delays in the rendering of the audio signals to the user.

Determining if one or more of the second audio signals were obtained within a threshold time may comprise determining if one or more of the second audio signals were received within a threshold time of the audio signal being emitted by the audio source.

Determining if one or more of the second audio signals were obtained within a threshold time may comprise determining if one or more of the second audio signals are received within a threshold time of the first audio signal.

The audio signals may be rendered for use in a mediated reality application.

The first microphone may be a local microphone.

The second microphone may be a far field microphone.

The second microphone may be a far field array.

The processing of the signals may comprise the time alignment of one or more signals.

A plurality of second signals may be obtained and the different second signals may be obtained from different microphones.

The processing of the one or more audio signals that are received within the time threshold may be initiated as soon as the time threshold has expired.

According to various, but not necessarily all, examples of the disclosure there is provided an apparatus comprising: processing circuitry; and memory circuitry including computer program code, the memory circuitry and the computer program code configured to, with the processing circuitry, cause the apparatus to: obtain a first audio signal emitted by an audio source, wherein the first audio signal is captured by a first microphone located at a first position; obtain at least one second audio signal emitted by the same audio source, wherein the at least one second audio signal is captured by one or more second microphones located at one or more second positions which are different to the first position; determine if one or more of the second audio signals were obtained within a threshold time; and if one or more second audio signals were obtained within the threshold time cause the one or more second audio signals that were obtained within the threshold time to be processed for rendering spatial audio to a user; and if one or more second audio signals were not obtained within the threshold time cause, at least part of, the one or more second audio signals that were not obtained within the threshold time to be discarded.

The threshold time may be determined by an interactivity index.

The threshold time may be determined so as to avoid perceptible delays in the rendering of the audio signals to the user.

The processing circuitry and memory circuitry may be configured to determine if one or more of the second audio signals were obtained within a threshold time by determining if one or more of the second audio signals were received within a threshold time of the audio signal being emitted by the audio source.

The processing circuitry and memory circuitry may be configured to determine if one or more of the second audio signals were obtained within a threshold time by determining if one or more of the second audio signals are received within a threshold time of the first audio signal.

The audio signals may be rendered for use in a mediated reality application.

The first microphone may be a local microphone.

The second microphone may be a far field microphone.

The second microphone may be a far field array.

The processing of the signals may comprise the time alignment of one or more signals. A plurality of second signals may be obtained and the different second signals may be obtained from different microphones.

The processing of the one or more audio signals that are received within the time threshold may be initiated as soon as the time threshold has expired.

According to various, but not necessarily all, examples of the disclosure there is provided an audio processing device comprising an apparatus as described above and one or more transceivers arranged to receive audio signals from microphones.

According to various, but not necessarily all, examples of the disclosure there is provided an apparatus comprising means for obtaining a first audio signal emitted by an audio source, wherein the first audio signal is captured by a first microphone located at a first position; means for obtaining at least one second audio signal emitted by the same audio source, wherein the at least one second audio signal is captured by one or more second microphones located at one or more second positions which are different to the first position; means for determining if one or more of the second audio signals were obtained within a threshold time; and means for causing, if one or more second audio signals were obtained within the threshold time, the one or more second audio signals that were obtained within the threshold time to be processed for rendering spatial audio to a user.

The apparatus may comprise means for enabling any of the methods disclosed in this description.

According to various, but not necessarily all, examples of the disclosure there is provided a computer program comprising computer program instructions that, when executed by processing circuitry, cause: obtaining a first audio signal emitted by an audio source, wherein the first audio signal is captured by a first microphone located at a first position; obtaining at least one second audio signal emitted by the same audio source, wherein the at least one second audio signal is captured by one or more second microphones located at one or more second positions which are different to the first position; determining if one or more of the second audio signals were obtained within a threshold time; and if one or more second audio signals were obtained within the threshold time causing the one or more second audio signals that were obtained within the threshold time to be processed for rendering spatial audio to a user; and if one or more second audio signals were not obtained within the threshold time causing, at least a portion of, the one or more second audio signals that were not obtained within the threshold time to be discarded.

According to various, but not necessarily all, examples of the disclosure there is provided a computer program comprising program instructions for causing a computer to perform the described methods.

According to various, but not necessarily all, examples of the disclosure there is provided a physical entity embodying the computer program as described.

According to various, but not necessarily all, examples of the disclosure there is provided an electromagnetic carrier signal carrying the computer program as described.

According to various, but not necessarily all, examples of the disclosure there are provided examples as claimed in the appended claims.

BRIEF DESCRIPTION

For a better understanding of various examples that are useful for understanding the detailed description, reference will now be made by way of example only to the accompanying drawings in which.

DETAILED DESCRIPTION

The following description describes methods, apparatus 61 and computer programs 69 that enable the delays between audio signals captured by different microphones to be accounted for. The methods, apparatus 61 and computer programs 69 may enable spatial audio processing so that spatial audio can be rendered for a user. The spatial audio could be provided as part of a mediated reality application such as a virtual reality or augmented reality application. In some applications the user may be able to move while listening to the rendered spatial audio. In such applications the described methods, apparatus and compute programs reduce latency in the audio processing caused by the distribution of the microphones and other components within the system so that an improved audio experience can be provided to the user.

Figure 1:
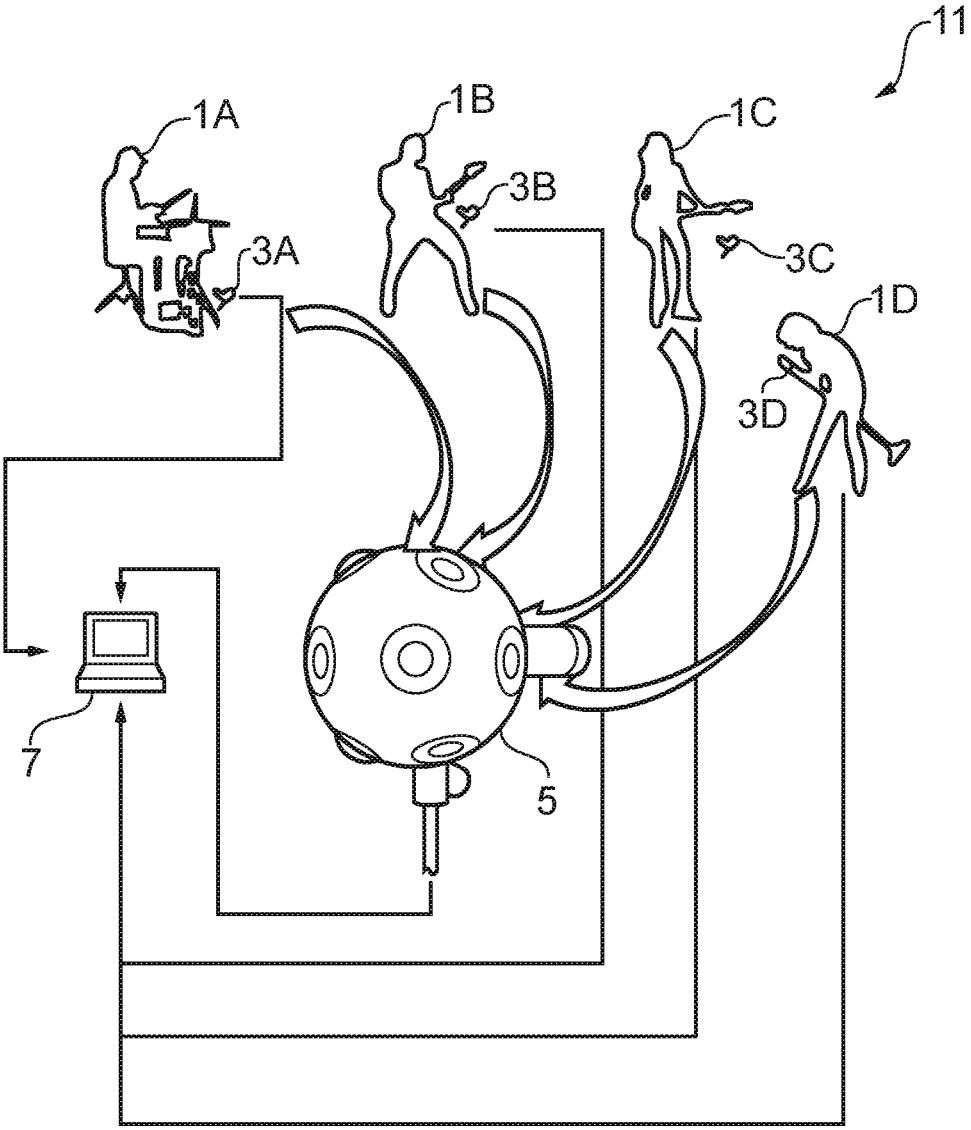
FIG. 1 illustrates a system for spatial audio capture.

FIG. 1 illustrates a system 11 arranged for spatial audio capture. The system 11 comprises a plurality of audio sources 1A, 1B, 1C, 1D, a plurality of microphones 3A, 3B, 3C, 3D, 5 arranged to capture audio signals emitted by the audio sources 1A, 1B, 1C, 1D and a processing device 7.

In the example of FIGS. 1A and 1B the plurality of audio sources 1A, 1B, 1C, 1D comprise a band or other group of musicians creating a musical audio recording. In the example system 11 of FIG. 1 four audio sources 1A, 1B, 1C, 1D are provided. The first audio source comprises a drummer, the second audio source 1B comprises a guitar, the third audio source 10 comprises another guitar and the fourth audio source 1D comprises a singer. It is to be appreciated that other types and numbers of audio sources 1 may be used in other examples of the disclosure. For instance, in some examples only a single audio source 1 might be provided. Also the audio sources 1 could be arranged to create any type of audio signal and not just a musical output.

A plurality of local microphones 3A, 3B, 3C, 3D are provided adjacent to the audio sources 1A, 1B, 1C, 1D. In the example system 11 of FIG. 1 one local microphone 3 is provided for each audio source 1. In other examples there could be a different number of audio sources 1 and local microphones 3. For instance, in some examples two or more audio sources 1 could be positioned adjacent to a local microphone 1, and/or two or more local microphones 3 could be positioned adjacent to an audio source 1.

The local microphones 3 comprise any suitable means which is arranged to convert a detected audio signal into a corresponding electrical signal. The local microphones 3 may comprise a lavalier microphone or any other suitable type of microphones.

Each of the local microphones 3 are positioned in proximity to, or adjacent to, a corresponding audio source 1. The first local microphone 3A is positioned in proximity to the first audio source 1A, the second local microphone 3B is positioned in proximity to the second audio source 1B, the third local microphone 3C is positioned in proximity to the third audio source 10 and the fourth local microphone 1D is positioned in proximity to the fourth audio source 1D. The local microphones 3A, 3B, 3C, 3D may be arranged to obtain local audio signals. The local audio signals may comprise information representing the audio sources 1A, 1B, 1C, 1D. The local audio signals may comprise more information representing the audio sources 1 than the ambient sounds. The local microphones 3A, 3B, 3C, 3D may be positioned in proximity to the audio sources 1A, 1B, 1C, 1D so that the time between the audio signal being emitted by the audio source 1A, 1B, 1C, 1D and the audio signal being detected by the corresponding local microphone 3A, 3B, 3C, 3D is negligible.

The example system 11 of FIG. 1 also comprises a microphone array 5. The microphone array 5 comprises one or more microphones. The microphones within the microphone array 5 comprise any suitable means which may be arranged to convert a detected audio signal into a corresponding electrical signal. The microphone array 5 could comprise any suitable type of microphones. In some examples the microphone array 5 may comprise far field microphones. In some examples the microphone array 5 may comprise an OZO device or any other suitable microphone array 5.

The microphone array 5 comprises a plurality of spatially separated microphones which may be arranged to capture spatial audio signals. The microphone array 5 is located within the system 11 so that it is not in proximity to, or adjacent to, any of the audio sources 1A, 1B, 10, 1D or local microphones 3A, 3B, 3C, 3D.

The microphone array 5 may be arranged to detect audio signals generated by each of the audio sources 1A, 1B, 1C, 1D within the system 11. As the microphone array 5 is not in proximity to, or adjacent to, the audio sources 1A, 1B, 1C, 1D there is a delay between the audio signals being generated by the audio sources 1A, 1B, 1C, 1D and the audio sources being detected by the microphone array 5. This delay will be dependent upon the distance between each of the respective audio sources 1A, 1B, 1C, 1D and the microphone array 5. This delay will be approximately 3 milliseconds for each meter between the audio sources 1A, 1B, 1C, 1D and the microphone array 5.

In the example system of FIG. 1 the audio signals captured by the local microphones 3A, 3B, 3C, 3D and the microphone array 5 are provided to a processing device 7. The processing device 7 comprises any means which may be arranged to temporally align the captured audio signals and enable a spatial audio output to be provided to a user. For example, the processing device could be a computer, a laptop, a handheld communication device or any other suitable processing device 7. In the example system 11 of FIG. 1 only one processing device 7 is shown. It is to be appreciated that in other examples the processing device 7 could comprise a number of interconnected devices.

The captured audio signals may be provided to the processing device 7 via any suitable communication links. In some examples the communication links may comprise wireless communication links. In some examples the communication links could comprise wired communication links. The communication links may introduce a delay into the system 11. The delay introduced by the communications link may be dependent upon the type of communication links and the hardware within the communication links and any other relevant features. The delay could be up to several milliseconds for each hop within the communications network.

Figure 2:
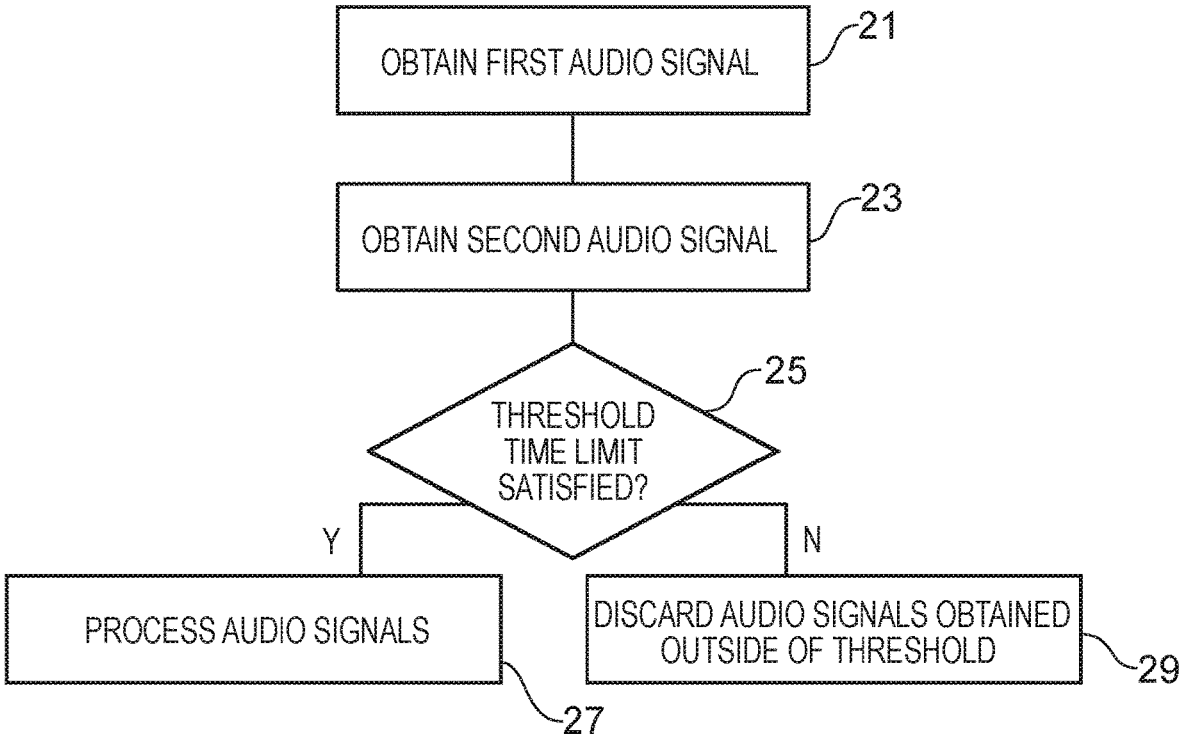
FIG. 2 illustrates a method of audio processing.

FIG. 2 illustrates an example method of audio processing which may be used to reduce the latency caused by the delays within the system 11. The method may be used to reduce the latency caused both by the physical separations of the microphones and also the delays within the communication system. The system 11 of FIG. 1 is given as an example. It is to be appreciated that the method could be implemented in any system which comprises spatially separated microphones 1, 5.

The method comprises, at block 21, obtaining a first audio signal emitted by an audio source 1. The first audio signal is captured by a first microphone 3 located at a first position. The first microphone 3 may be a local microphone 3. The first position may be adjacent to, or in close proximity to, the audio source 1.

At block 23 the method comprises obtaining at least one second audio signal emitted by the same audio source 1. The at least one second audio signal may be obtained at a time after the first audio signal. The at least one second audio signal is captured by one or more second microphones located at one or more second positions which are different to the first position. The one or more second microphones could be microphones within the microphone array 5.

One or more of the second microphones 5 may be a far field microphone. The distance between the one or more second microphones 5 and the audio source 1 may be greater than the distance between the first microphone 3 and the audio source 1. This causes a delay between the first microphone 3 capturing the first audio signal and the one or more second microphones 5 capturing the second audio signal.

The first and second audio signals may be obtained by the processing device 7. The processing device 7 may obtain the first and second audio signals by receiving the captured audio signals from the first microphone 3 and the second microphone 5 via communication links. The communication links may also generate a delay between the time at which the first audio signal is obtained and the time and which the second audio signal is obtained. The delays incurred by the communication link may be dependent upon the number of hops in the communication network between the microphones 3, 5 and the processing device 7.

At block 25 the method comprises determining if one or more of the second audio signals were obtained within a threshold time. For example the method may comprise determining if a second audio signal is obtained within a threshold time from the emission of the audio signal by the audio source 1, or within a threshold time from the obtaining of the first audio signal. In some examples the method could comprise determining if a plurality of second audio signals are received within the threshold time. In some examples it may be determined whether or not the signals are received within a threshold time from the emission of the audio signal by the audio source 1.

The threshold time may be determined by an interactivity index. The threshold time may be determined so as to avoid perceptible delays in the rendering of the audio signals to the user. For example, the threshold time may be selected so that the audio signals obtained within the threshold time may be processed and rendered to the user without any perceptible artefacts caused by the delay. Audio signals obtained outside of the threshold time may cause perceptible artefacts and/or delay if they are rendered and provided to the user. For example they may cause the user to hear distortion in the audio such as additional reverberation or hear the same sound object more than once.

The magnitude of the threshold time may depend on one or more various factors. In some examples the magnitude of the threshold time may depend on the way the user is interacting with the rendered audio. For instance it may depend on whether the user of mediated reality content, or other spatial audio, is moving within a rendered sound space. In some examples the magnitude of the threshold time may depend on factors such as the type of audio being rendered, the distance between the first microphone and the second microphone, the delays within the communication network and any other suitable factors.

Any suitable method or process may be used to determine if one or more of the second audio signals were obtained within a threshold time. In some examples the process may comprise estimating the delay in obtaining the one or more second audio signasl using information relating to the relative positions of the microphones 3, 5 and the audio source 1 or any other suitable method.

If one or more second audio signals were obtained within the threshold time, then at block 27 the method comprises, causing the one or more second audio signals that were obtained within the threshold time to be processed for rendering spatial audio to a user. For instance, if a second audio signal is obtained within the threshold time then both the first and second audio signal are processed for providing spatial audio. The first and second audio signals could be processed using any suitable techniques. The processing of the first and second audio signals may comprise time alignment of the first and second audio signals. The processing of the first and second audio signals may comprise combining and/or mixing the first and second audio signals.

If one or more second audio signals were not obtained within the threshold time, then at block 29 the method comprises causing the one or more second audio signals, or portions of the second audio signals, that were not obtained within the threshold time to be discarded. For instance, if the first audio signal is obtained within the threshold time but a second audio signal is obtained outside of the threshold time then the second audio signal is discarded so that the first audio signal is rendered for processing to a user. The second audio signal could be discarded so that it is not used for the spatial audio signal. The portion of the second audio signal that is discarded may correspond to the audio source 1. The ambient noise or far field audio or other information may be retained. For instance, the second audio signal may be used to obtain a room impulse response which can then be used to modify the first audio signal. In such examples the spatial audio signal that is rendered to the user only comprises information from the first and second audio signals that were obtained within the threshold time.

In the example method of FIG. 2 shows a first audio signal and a second audio signal being obtained. The second audio signal may comprise any audio signal that is received after the first audio signal and which comprises audio emitted by the same audio source 1. In the above described example the first audio signal is obtained from a local microphone while a second audio signal is obtained from a far field microphone however different arrangements of microphones may be used in other examples of the disclosure.

It is to be appreciated that a plurality of second audio signals could be obtained in implementations of the disclosure. In such examples a first subset of the second audio signals could be obtained within the threshold time while a second subset of the second audio signals could be obtained outside of the threshold time. The example method of FIG. 2 may be implemented for each of the second audio signals so that the subset of audio signals obtained within the threshold time can be processed to provide the spatial audio signal while the subset of audio signals obtained outside of the threshold time can be discarded.

The example method of FIG. 2 could be performed by a processing device 7 as shown in FIG. 1. Other types of devices could be used to implement the method in other examples. In some examples the method could be implemented by a single device. In other examples the method could be implemented by a plurality of interconnected devices so that different devices perform different parts of the method.

Figure 3:
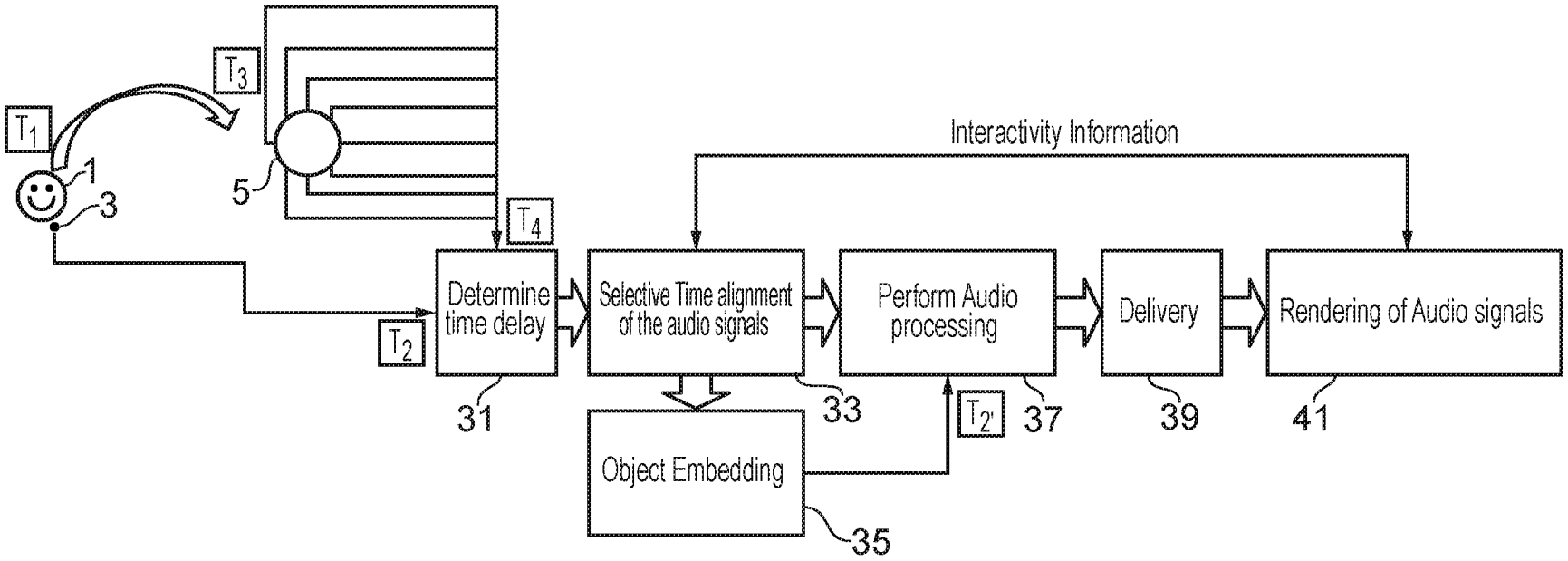
FIG. 3 illustrates a method of audio processing.

FIG. 3 illustrates another method of audio processing according to examples of the disclosure.

At time $T_1$ a first audio signal emitted by the audio source 1 is captured by a local microphone 3. The local microphone 3 is positioned adjacent to the audio source 1. At time $T_2$ the audio signal captured by the first microphone 3 is obtained by the processing device 7. The audio signal captured by the microphone 3 may be transmitted to the processing evice 7 via any suitable communication link. The delay between time $T_2$ and time $T_1$ depends on the delay within the communication network which connects the local microphone 3 to the processing device 7.

At time $T_3$ a second audio signal emitted by the same audio source 1 is captured by the microphone array 5. The microphone array 5 may comprise a plurality of microphones and so may obtain a plurality of second audio signals. The distance between the microphone array 5 and the audio source 1 is greater than the distance between the local microphone 3 and the audio source 1. In some examples the microphone array 5 could be tens of meters or hundreds of meters away from the audio source 1 while the local microphone 3 may be positioned within several centimeters of the audio source 1. The delay between time $T_3$ and time $T_1$ depends upon the distance between the local microphone 3 and the microphone array 5. In some examples the delay between time $T_3$ and time $T_1$ could be greater than the delay between time $T_2$ and time $T_1$. In such cases the processing device 7 could obtain the first audio signal before the microphone array 5 receives the second audio signal.

At time $T_4$ the audio signal captured by the microphone array 5 is obtained by the processing device 7. The delay between time $T_4$ and time $T_3$ depends on the delay within the communication system which connects the microphone array 5 to the processing device 7.

At block 31 the processing device 7 determines the time delay for the audio signals. The time delay may be the time between the audio signal being emitted by the audio source 1 and the audio signal being obtained by the processing device 1. This delay takes into account the propagation delays arising from the physical separation of the audio source 1 and the microphones 3, 5 and also network delays introduced by the communication links and any other suitable factors. The time delay for the first audio signal may be much smaller than the time delay for the second audio signal because the first microphone 3 is positioned closer to the audio source 1 than the second microphone 5.

Any suitable process may be used to determine the time delays. In some examples information relating to the relative locations of the microphones 3, 5 and the audio sources 1 may be used to enable the delays to be determined.

At block 33 the processing device 7 performs selective time alignment of the obtained audio signals. The time alignment is selective in that only audio signals obtained within a threshold time are used for the time alignment. The audio signals that are received outside of the threshold time may be discarded.

The time alignment may comprise any suitable process. The time alignment may comprise adding an adjustable delay to one or more of the audio signals that were received within the time threshold.

At block 35 the processing device 7 performs object embedding. The audio signals that were received within the threshold time may be used to perform the spatial audio processing.

At block 35 the processing device 7 may also perform other processing on the audio signals that are received within the threshold time limit. In some examples the processing device 7 may add capture room acoustics to the time aligned audio signals. The adding of capture room acoustics may comprise applying an impulse response filter which enables spatial aspects of the audio signals to be recreated. For example a room impulse response filter may be applied to include capture room acoustics that would be heard by a user in the room of the audio source 1 to be recreated to a user hearing the audio via a rendering device. Other types of filters and audio effects may be added in other examples of the disclosure.

At block 37 the processing device 7 performs spatial audio processing. The spatial audio processing may be performed on the time aligned signals and/or the embedded audio signals. The audio signals that have been received after the threshold time limit are removed from the audio signals that are used for spatial processing. This enables the spatial processing to be performed at time $T_{4'}$. Time $T_{4'}$ may occur before time $T_4$. That is, the spatial audio processing may be, at least partially, performed before the second audio signal is obtained by the processing device 7. This reduces the latency in the processing of the spatial audio signals.

The spatial audio processing may comprise any suitable type of processing that enables a spatial audio signal to be rendered to a user. In some examples the spatial audio processing may comprise source separation. This may enable audio signals emitted by different audio sources 1 to be separated from each other. In some examples the spatial audio processing may comprise modifying the audio outputs so as to enable movement of a user while the audio is being rendered. In some examples it may enable six degrees of freedom of movement of the user. This may allow the user to move in lateral directions as well as rotate to change their orientation. In such examples the spatial audio processing may comprise modifying the perceived direction of arrival and/or volume of an audio source and/or any other parameters of the audio source.

At block 39 the processed audio is delivered to a rendering device. The processed audio may be delivered to a rendering device via any suitable means. In some examples the processed audio may be delivered to the rendering device via a wireless communication link or any other suitable means. In some examples the processed audio may be delivered to more than one rendering device.

The rendering device comprises any means which may be arranged to convert electrical input signals into audio output signals. In some examples the rendering device comprises a head set or head phones. In some examples rendering device may enable virtual reality or augmented reality content to be rendered for the user. For instance, the rendering device may comprise one or more displays arranged to display the virtual reality or augmented reality content.

At block 41 the audio signals are rendered by the rendering device. The rendering device may enable the user to interact the rendered audio content. In some cases the interaction could be an explicit interaction, that is the user could make user inputs that the control the rendered audio output. For example, the user could make one or more user inputs to adjust parameters of the rendered audio output. For instance a user may wish to increase the volume of a first audio source and decrease the volume of a second different audio source.

In some cases the interaction could be an implicit interaction. In such cases the adjustment of the audio output could be secondary to an action of the user. For instance the rendering device may be a device that can be worn by the user so that the user can move while listening to the rendered audio content. In such cases, if the user moves the rendered audio content needs to be adjusted to take into account the new position of the user. For example, the audio content would need to be adjusted if the user rotates their head and/or if they move laterally.

In some examples the rendering device may provide feedback to the processing device. The feedback provided by the rendering device may provide an indication of the latency that can be tolerated by the rendering device without causing perfectible artifacts to be rendered to the user. In some examples the feedback may comprise information indicative of an interactivity index. The information received from the rendering device may be used to determine the threshold time that should be applied to the obtained audio signals.

Figure 4A:
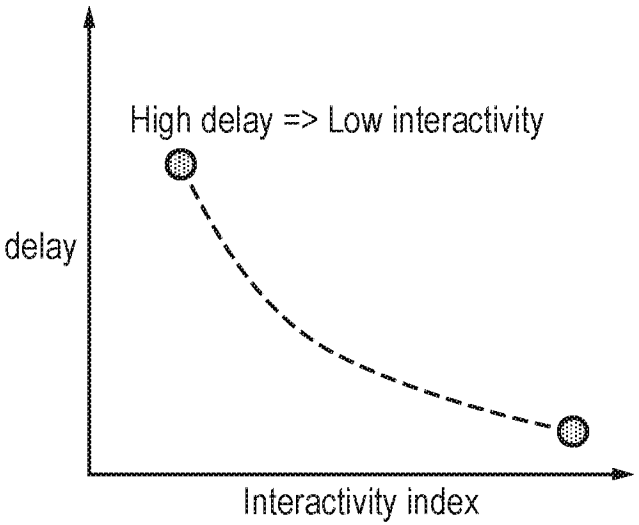
FIGS. 4A and 4B illustrate plots of interactivity indices.
Figure 4B:
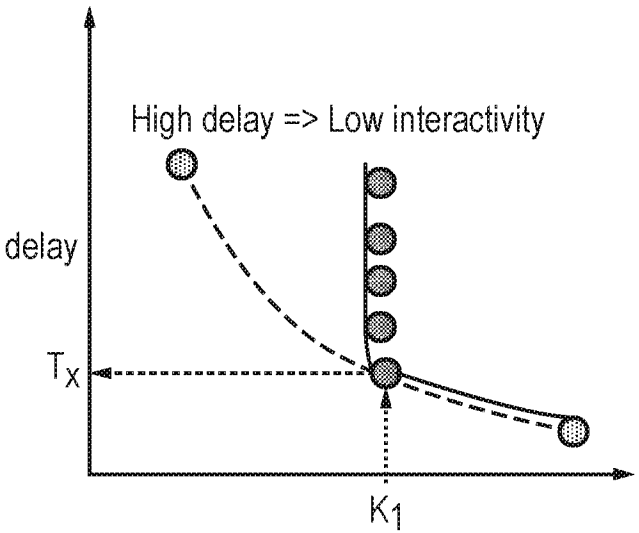

FIGS. 4A and 4B illustrate plots of interactivity indices. The interactivity index gives a measure of the levels of the delay that can be tolerated by the audio processing system. A small amount of delay might not be noticed by the user or could be accounted for by audio processing whereas a larger delay could result in unwanted artefacts within the rendered audio. Different interactivity indices could be used in different contexts, for example different interactivity indices could be used for different audio applications. In some examples different interactivity indices could be used for different users and/or different types of audio content.

FIG. 4A shows a plot of an interactivity index for a system which does not use examples of the disclosure. In these examples the interactivity index is inversely proportional to the delays within the system. Where the system has a high level of delay this results in a low interactivity index. This may reduce the quality of the audio content available to the user. In such cases if a user interacts with the audio content, for example, if they move within a mediated reality space, this may result in artefacts such as echo or extended sounds being rendered in the audio content.

FIG. 4B shows a plot of an interactivity index for a system which does use examples of the disclosure. In such examples the required interactivity index is indicated as $K_1$. The required interactivity index may be determined based on a number of factors such as the way in which the user is interacting with the audio content, the type of audio content or any other suitable factors.

The required interactivity index $K_1$ is then used to determine the threshold time limit $T_x$ and the delays which may be tolerated within the system. Audio signals that are received within the time threshold can be used for audio processing while audio signals that are received outside of the threshold time limit can be discarded to ensure that the required interactivity index is satisfied. This maintains a constant level of interactivity for the system regardless of the delays that are introduced by the spatial separation of the microphones 3, 5 and the communication network and any other factors.

Figure 5:
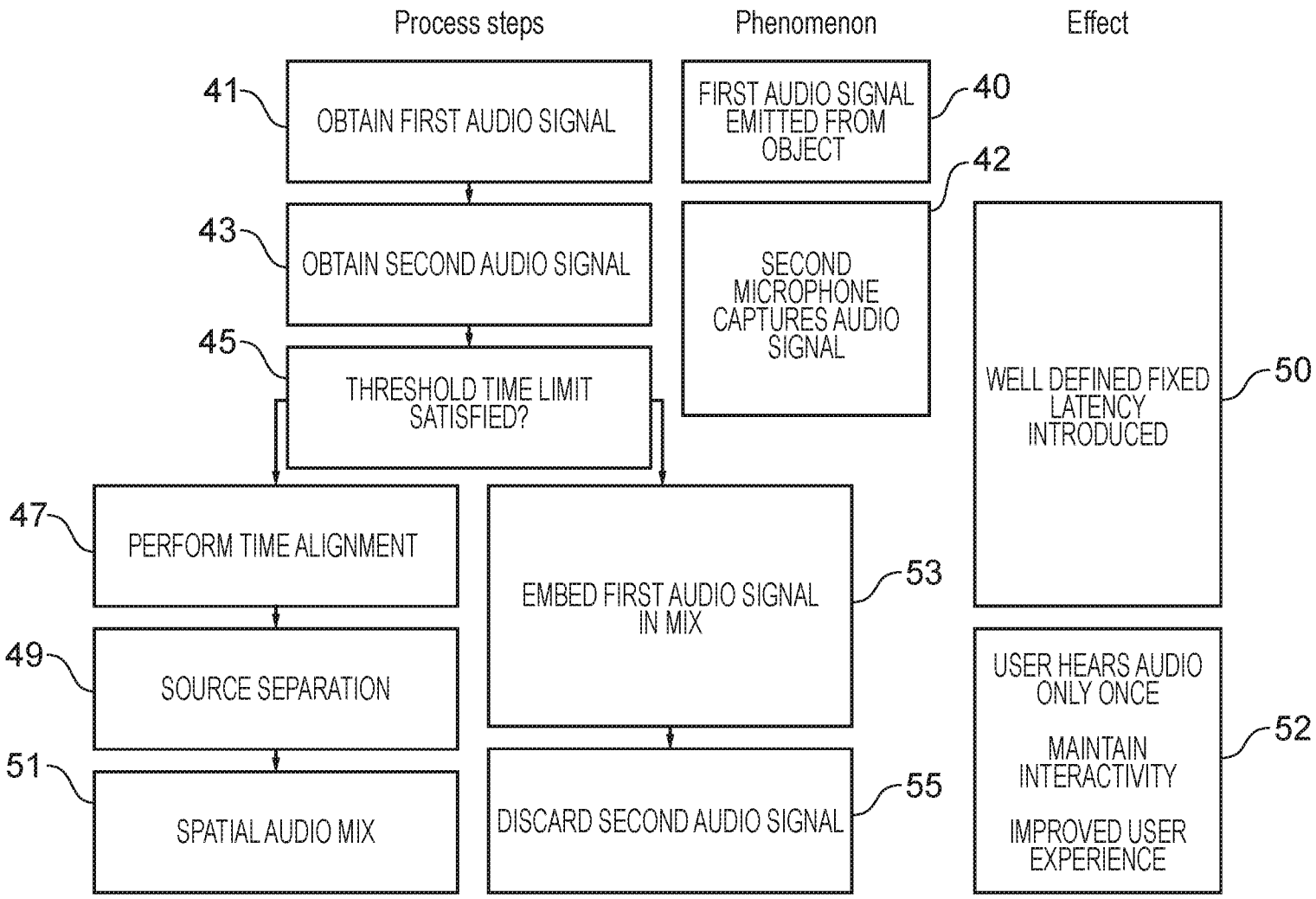
FIG. 5 illustrates a method of audio processing.

FIG. 5 illustrates another method of audio processing. The example method of FIG. 5 shows the blocks of a process which may be performed by a processing device 7. The example method of FIG. 5 also shows the blocks which may be performed by other parts of the system and the effect this provides to the user.

At block 41 the processing device 7 obtains the first audio signal which is captured by the first microphone 3. As the first microphone 3 is positioned adjacent to the audio source 1 there may only be a small delay between the first audio signal being emitted 40 from the audio source 1 and the first audio signal being obtained. The delay between the audio source emitting the audio signal and the processing device 7 obtaining the first audio signal may be negligible.

At block 43 the processing device 7 obtains a second audio signal which is captured 42 by the second microphone 5. As distance between the audio source 1 and the second microphone 5 is greater than the distance between the audio source 1 and the first microphone 3 there is a larger delay between the audio signal being emitted by the audio source 1 and the second audio signal being obtained.

At block 45 it is determined whether or not the audio signals have been obtained within a threshold time. In some examples it may be determined if the audio signals are received within a threshold time of the audio signal being emitted by the audio source 1. In some examples it may be determined if the second audio signal is received within a threshold time from the first audio signal.

If the audio signals are obtained within the threshold time limit then, at block 47 the processing device 7 performs time alignment on the obtained audio signals. The time alignment may be performed for any audio signals that are received within the threshold time limit.

At block 49 source separation is performed on the time aligned signals. The source separation may comprise separating audio signals which have been emitted by different audio sources.

At block 51 spatial audio mixing is performed. The spatial audio mixing may comprise any process which enables spatial audio to be rendered to a user.

If one or more of the audio signals are not received within the threshold time limit then signals received outside of the threshold time limit are not added to the spatial audio mix. For example, if the first audio signal is received within the threshold time limit but the second audio signal is not received within the threshold time limit then, at block 53 the first audio signal is embedded into the spatial audio mix and the second audio signal is discarded at block 55.

Examples of the disclosure provide the advantage of introducing 50 a well-defined latency into the system. An interactivity index, or other parameter, can be defined which sets a threshold time within which the audio signals used for spatial processing are received. The interactivity index can be set by the actions of the user or by and other suitable actions or factors. In some examples threshold time could be set so that the spatial audio can be rendered to the user before a second audio signal is even received by the second microphone. This may provide a highly interactive audio system.

Examples of the disclosure also provide the advantage of providing 52 improved audio for the user. As audio signals received outside of a threshold time limit are discarded this avoids the same audio, captured by different microphones, being repeated within the rendered content. This may also provide improved user interactivity for the rendering systems. For example it may provide a more realistic audio experience for a user moving while using a mediated reality content application which provides for an improved user experience.

Figure 6:
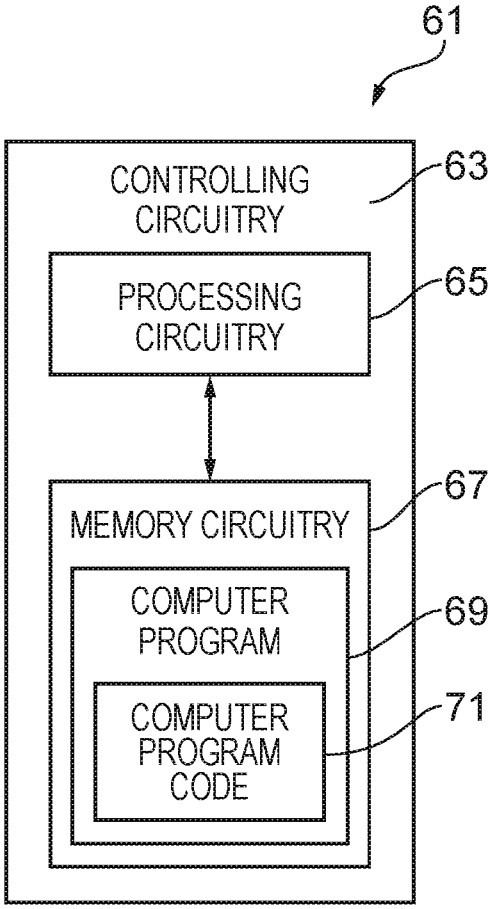
FIG. 6 illustrates an apparatus.

FIG. 6 schematically illustrates an apparatus 61 according to examples of the disclosure. The apparatus 61 may provide means for implementing any of the examples and methods described above. The apparatus 61 illustrated in FIG. 6 may be a chip or a chip-set. In some examples the apparatus 61 may be provided within devices such as a processing device 7. In some examples the apparatus 61 may be provided within an audio capture devices or an audio rendering device or any other suitable type of device.

The apparatus 61 comprises controlling circuitry 63. The controlling circuitry 63 may provide means for controlling an electronic device such as processing device 63 or a rendering device. The controlling circuitry 63 may also provide means for performing the methods or at least part of the methods of examples of the disclosure.

The apparatus 61 comprises processing circuitry 65 and memory circuitry 67. The processing circuitry 65 may be configured to read from and write to the memory circuitry 67. The processing circuitry 65 may comprise one or more processors. The processing circuitry 65 may also comprise an output interface via which data and/or commands are output by the processing circuitry 65 and an input interface via which data and/or commands are input to the processing circuitry 65.

The memory circuitry 67 may be configured to store a computer program 69 comprising computer program instructions (computer program code 71) that controls the operation of the apparatus 61 when loaded into processing circuitry 65. The computer program instructions, of the computer program 69, provide the logic and routines that enable the apparatus 61 to perform the example methods described above. The processing circuitry 65 by reading the memory circuitry 67 is able to load and execute the computer program 69.

The computer program 69 may arrive at the apparatus 61 via any suitable delivery mechanism. The delivery mechanism may be, for example, a non-transitory computer-readable storage medium, a computer program product, a memory device, a record medium such as a compact disc read-only memory (CD-ROM) or digital versatile disc (DVD), or an article of manufacture that tangibly embodies the computer program. The delivery mechanism may be a signal configured to reliably transfer the computer program 69. The apparatus may propagate or transmit the computer program 69 as a computer data signal.

In some examples the computer program code 69 may be transmitted to the apparatus 61 using a wireless protocol such as Bluetooth, Bluetooth Low Energy, Bluetooth Smart, 6LoWPan ($IP_v6$ over low power personal area networks) ZigBee, ANT+, near field communication (NFC), Radio frequency identification, wireless local area network (wireless LAN) or any other suitable protocol.

Although the memory circuitry 67 is illustrated as a single component in the figures it is to be appreciated that it may be implemented as one or more separate components some or all of which may be integrated/removable and/or may provide permanent/semi-permanent/dynamic/cached storage.

Although the processing circuitry 65 is illustrated as a single component in the figures it is to be appreciated that it may be implemented as one or more separate components some or all of which may be integrated/removable.

References to "computer-readable storage medium", "computer program product", "tangibly embodied computer program" etc. or a "controller", "computer", "processor" etc. should be understood to encompass not only computers having different architectures such as single/multi-processor architectures, Reduced Instruction Set Computing (RISC) and sequential (Von Neumann)/parallel architectures but also specialized circuits such as field-programmable gate arrays (FPGA), application-specific integrated circuits (ASIC), signal processing devices and other processing circuitry. References to computer program, instructions, code etc. should be understood to encompass software for a programmable processor or firmware such as, for example, the programmable content of a hardware device whether instructions for a processor, or configuration settings for a fixed-function device, gate array or programmable logic device etc.

As used in this application, the term "circuitry" refers to all of the following:

(a) hardware-only circuit implementations (such as implementations in only analog and/or digital circuitry) and (b) to combinations of circuits and software (and/or firmware), such as (as applicable): (i) to a combination of processor(s) or (ii) to portions of processor(s)/software (including digital signal processor(s)), software, and memory(ies) that work together to cause an apparatus, such as a mobile phone or server, to perform various functions) and (c) to circuits, such as a microprocessor(s) or a portion of a microprocessor(s), that require software or firmware for operation, even if the software or firmware is not physically present.

This definition of "circuitry" applies to all uses of this term in this application, including in any claims. As a further example, as used in this application, the term "circuitry" would also cover an implementation of merely a processor (or multiple processors) or portion of a processor and its (or their) accompanying software and/or firmware. The term "circuitry" would also cover, for example and if applicable to the particular claim element, a baseband integrated circuit or applications processor integrated circuit for a mobile phone or a similar integrated circuit in a server, a cellular network device, or other network device.

The term "comprise" is used in this document with an inclusive not an exclusive meaning. That is any reference to X comprising Y indicates that X may comprise only one Y or may comprise more than one Y. If it is intended to use "comprise" with an exclusive meaning then it will be made clear in the context by referring to "comprising only one" or by using "consisting".

In this brief description, reference has been made to various examples. The description of features or functions in relation to an example indicates that those features or functions are present in that example. The use of the term "example" or "for example" or "may" in the text denotes, whether explicitly stated or not, that such features or functions are present in at least the described example, whether described as an example or not, and that they can be, but are not necessarily, present in some of or all other examples. Thus "example", "for example" or "may" refers to a particular instance in a class of examples. A property of the instance can be a property of only that instance or a property of the class or a property of a sub-class of the class that includes some but not all of the instances in the class. It is therefore implicitly disclosed that a features described with reference to one example but not with reference to another example, can where possible be used in that other example but does not necessarily have to be used in that other example.

Although embodiments of the present invention have been described in the preceding paragraphs with reference to various examples, it should be appreciated that modifications to the examples given can be made without departing from the scope of the invention as claimed.

Features described in the preceding description may be used in combinations other than the combinations explicitly described.

Although functions have been described with reference to certain features, those functions may be performable by other features whether described or not.

Although features have been described with reference to certain embodiments, those features may also be present in other embodiments whether described or not.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

We claim:

1. A method comprising:

obtaining a first audio signal emitted by an audio source, wherein the first audio signal is captured by a first microphone located at a first position;

obtaining at least one second audio signal emitted by the same audio source, wherein the at least one second audio signal is captured by one or more second microphones located at one or more second positions which are different to the first position;

determining if one or more of the second audio signals were obtained within a threshold time, wherein the threshold time is at least one of: determined by an interactivity index: or determined so as to avoid perceptible delays in a rendering of audio signals to a user; and if one or more second audio signals were obtained within the threshold time causing the one or more second audio signals that were obtained within the threshold time to be processed for rendering spatial audio to the user; and if one or more second audio signals were not obtained within the threshold time causing, at least part of, the one or more second audio signals that were not obtained within the threshold time to be discarded.

2. A method as claimed in claim 1, wherein determining if one or more of the second audio signals were obtained within a threshold time comprises determining if one or more of the second audio signals were received within the threshold time of the second audio signal being emitted by the audio source.

3. A method as claimed in claim 1, wherein determining if one or more of the second audio signals were obtained within a threshold time comprises determining if one or more of the second audio signals were received within the threshold time of the first audio signal.

4. A method as claimed in claim 1, wherein the second audio signals are rendered for use in a mediated reality application.

5. A method as claimed in claim 1, wherein the first microphone is a local microphone.

6. A method as claimed in claim 1, wherein the second microphone is at least one of:

a far field microphone; or a far field array.

7. A method as claimed in claim 1, wherein the processing of the second audio signals comprises a time alignment of one or more second audio signals.

8. A method as claimed in claim 1, wherein a plurality of second audio signals are obtained from different microphones.

9. A method as claimed in claim 1, wherein the processing of the one or more second audio signals that are received within the threshold time is initiated as soon as the threshold time has expired.

10. An apparatus comprising:

processing circuitry; and memory circuitry including a non-transitory computer readable storage medium storing computer program code, the memory circuitry and the computer program code configured to, with the processing circuitry, cause the apparatus to:

obtain a first audio signal emitted by an audio source, wherein the first audio signal is captured by a first microphone located at a first position;

obtain at least one second audio signal emitted by the same audio source, wherein the at least one second audio signal is captured by one or more second microphones located at one or more second positions which are different to the first position;

determine if one or more of the second audio signals were obtained within a threshold time, wherein the threshold time is at least one of: determined by an interactivity index: or determined so as to avoid perceptible delays in a rendering of audio signals to a user; and if one or more second audio signals were obtained within the threshold time cause the one or more second audio signals that were obtained within the threshold time to be processed for rendering spatial audio to the user; and if one or more second audio signals were not obtained within the threshold time cause, at least part of, the one or more second audio signals that were not obtained within the threshold time to be discarded.

11. An apparatus as claimed in claim 10, wherein the processing circuitry and memory circuitry are configured to determine if one or more of the second audio signals were obtained within a threshold time by determining if one or more of the second audio signals were received within the threshold time of the second audio signal being emitted by the audio source.

12. An apparatus as claimed in claim 10, wherein the processing circuitry and memory circuitry are configured to determine if one or more of the second audio signals were obtained within a threshold time by determining if one or more of the second audio signals were received within the threshold time of the first audio signal.

13. An apparatus as claimed in claim 10, wherein the second audio signals are rendered for use in a mediated reality application.

14. An apparatus as claimed in claim 10, wherein the first microphone is a local microphone.

15. An apparatus as claimed in claim 10, wherein the second microphone is at least one of:

a far field microphone; or a fair field array.

16. An apparatus as claimed in claim 10, wherein the processing of the one or more second audio signals comprises a time alignment of the one or more second audio signals.

17. An apparatus as claimed in claim 10, wherein a plurality of second audio signals are obtained from different microphones.

18. An apparatus as claimed in claim 10, wherein the processing of the one or more second audio signals that are received within the threshold time is initiated as soon as the threshold time has expired.

19. A computer program product comprises at least one non-transitory computer-readable storage medium having computer executable program code instructions stored therein, the computer executable program code instructions comprising program code instructions configured, upon execution, to:

obtain a first audio signal emitted by an audio source, wherein the first audio signal is captured by a first microphone located at a first position;

obtain at least one second audio signal emitted by the same audio source, wherein the at least one second audio signal is captured by one or more second microphones located at one or more second positions which are different to the first position;

determine if one or more of the second audio signals were obtained within a threshold time, wherein the threshold time is at least one of: determined by an interactivity index: or determined so as to avoid perceptible delays in a rendering of audio signals to a user; and if one or more second audio signals were obtained within the threshold time cause the one or more second audio signals that were obtained within the threshold time to be processed for rendering spatial audio to the user; and if one or more second audio signals were not obtained within the threshold time cause, at least part of, the one or more second audio signals that were not obtained within the threshold time to be discarded.

20. The computer program product of claim 19, wherein the program code instructions configured to determine if one or more of the second audio signals were obtained within a threshold time comprise program code instructions configured to determine if one or more of the second audio signals were received within the threshold time of the second audio signal being emitted by the audio source.

* * * * *